US005611948A

United States Patent [19]

Hawkins

[11] Patent Number: 5,611,948

[45] Date of Patent: Mar. 18, 1997

[54] APPARATUS AND METHOD FOR REMOTELY POSITIONING A PROBE IN A TUBULAR MEMBER

[75] Inventor: Phillip J. Hawkins, Hempfield Township, Westmoreland County, Pa.

[73] Assignee: Westinghouse Electric Corporation, Pittsburgh, Pa.

[21] Appl. No.: 333,090

[22] Filed: Oct. 31, 1994

[51] Int. Cl.[6] ..... B23K 26/00

[52] U.S. Cl. ..... 219/121.63; 73/847; 376/245; 376/260

[58] Field of Search ..... 219/121.63; 73/847, 73/857; 376/245, 249, 260; 976/DIG. 212, DIG. 213, DIG. 214; 242/364, 410, 550, 563; 74/111, 114

[56] References Cited

U.S. PATENT DOCUMENTS

| | | | |
|---|---|---|---|
| 3,926,040 | 12/1975 | Cowell | 376/245 |
| 4,253,914 | 3/1981 | Fogelberg | 376/245 |
| 4,507,082 | 3/1985 | Wardlow, III . | |
| 4,567,012 | 1/1986 | Radcliff . | |
| 4,633,177 | 12/1986 | David et al. . | |
| 4,639,994 | 2/1987 | Cooper, Jr. et al. . | |
| 4,643,029 | 2/1987 | Klinvex . | |
| 4,649,989 | 3/1987 | Vermaat et al. . | |
| 4,694,677 | 9/1987 | Rabe . | |
| 4,856,354 | 8/1989 | Overbay | 376/249 |
| 4,978,834 | 12/1990 | Griffaton | 219/121.63 |
| 4,989,581 | 2/1991 | Tamburrino et al. | 600/103 |
| 5,000,681 | 3/1991 | Zafred et al. . | |
| 5,023,046 | 6/1991 | Speight | 376/245 |
| 5,061,176 | 10/1991 | Zafred et al. . | |
| 5,355,063 | 10/1994 | Boone et al. | 318/568.11 |
| 5,396,525 | 3/1995 | Domy et al. | 376/249 |

*Primary Examiner*—Tu B. Hoang
*Assistant Examiner*—Gregory L. Mills
*Attorney, Agent, or Firm*—Walter S. Stevens

[57] ABSTRACT

Apparatus and method for remotely positioning a probe, such as an examination or repair probe, in a tubular member. The tubular member may be a nuclear steam generator heat transfer tube to be examined or repaired by the probe. The probe is connected to a conduit which supports the probe as the probe advances along the inner diameter of the tube to the location of the tube requiring examination or repair. The conduit has a portion thereof wound about a take-up reel. As the probe and conduit advance in the tube, it unwinds from about the take-up reel. However, as the conduit unwinds from about the take-up reel, it may tend to develop a "kinked", twisted or contorted region therein inducing torsional stress in the conduit. Such torsional stress may be severe enough to break the conduit. The apparatus of the invention includes a gripper capable of gripping the conduit and also includes a rotator connected to the gripper for rotating both the gripper and the conduit gripped thereby. As the rotator rotates the gripper, the gripper and a portion of the conduit simultaneously rotate for removing the contorted region, so that the torsional stress induced in the conduit is relieved.

26 Claims, 7 Drawing Sheets

APPARATUS AND METHOD FOR REMOTELY POSITIONING A PROBE IN A TUBULAR MEMBER

BACKGROUND

This invention generally relates to positioning apparatus and methods and more particularly relates to an apparatus and method for remotely positioning an examination or repair probe in a tubular member, which tubular member may be a nuclear steam generator heat transfer tube having a corroded portion to be examined and repaired.

Occasionally, steam generator tubes may corrode or degrade and thus may not remain leak-tight. If through-wall degradation occurs, the radioactive primary fluid flowing in the tubes may leak through the degraded portion and commingle with the nonradioactive secondary fluid surrounding the tubes, a highly undesirable result.

Therefore, the heat transfer tubes are inspected for degradation and then repaired, if necessary, to avoid commingling the radioactive primary fluid with the non-radioactive secondary fluid. Such tubes are inspected by advancing an examination probe (e.g., an eddy current probe or an ultrasonic probe) along the inside diameter of the tube to detect any degradation in the tube wall. If the wall of the tube is degraded, it can be repaired by affixing a repair sleeve to the inside diameter portion of the tube that evinces the degradation. The repair sleeve may be affixed to the inside diameter of the tube by means of an expansion mandrel repair probe, which may be a hydraulic expansion mandrel device. Covering the degraded portion of the tube in this manner prevents commingling the radioactive primary fluid with the nonradioactive secondary fluid. A laser welding repair probe may then be advanced to the location of the sleeve and used to weld the sleeve to the inside diameter of the tube, if desired, in order to securely attach and seal the sleeve to the inside diameter of the tube.

During either examination or repair of the tube, the probe would have been previously connected to an end of a flexible conduit, which is used to axially advance the examination or repair probe to the location of the degradation. The conduit also provides a means through which may pass any required electrical leads connected to the examination probe for supplying power to the examination probe. The conduit may also serve as a means through which any hydraulic fluid is conducted to the repair probe for hydraulically expanding the sleeve into engagement with the tube, when the probe is a hydraulic expander device. In addition, the conduit may serve as a means through which any laser light beams may pass to a laser welding repair probe for laser welding the sleeve to the tube in order to attach and seal the sleeve to the inside diameter of the tube.

The flexible conduit to which the examination or repair probe is attached is wound about a storage drum or take-up reel for compactly storing the conduit when not in use. As the probe axially translates in the tube to perform its examination or repair function, the conduit unwinds from the take-up reel.

However, applicant has observed that as the flexible conduit unwinds from the take-up reel, a portion of the conduit may twist or "kink" Twisting or "kinking" of the conduit is undesirable because such twisting or kinking may be severe enough to sever or break the conduit due to torsional stress induced in the conduit as a result of the twisting or kinking. Breaking of the conduit may in turn cause any electrical leads extending through the conduit to break, thereby making the examination probe inoperable. Moreover, in the instance when the probe is a hydraulically-operated repair probe for purposes of sleeving, breaking of the conduit may interrupt flow of hydraulic fluid to the repair probe, thereby impeding the ability of the repair probe to hydraulically expand the sleeve into engagement with the tube. In addition, in the instance when the repair probe is a laser welding repair probe, breaking of the conduit will interrupt the laser light beam passing through the conduit to the probe, thereby hindering the ability of the repair probe to laser weld the sleeve to the tube. Of course, if the conduit breaks, it must be replaced in order to proceed with the examination or repair of the degraded tube. Replacing the conduit is a time-consuming and costly process. Therefore, there has been a long felt need in the art to prevent or mitigate twisting or "kinking" of the flexible conduit as it unwinds from the take-up reel in order to avoid severing or breaking the conduit.

Moreover, when the previously mentioned laser welding repair probe is used, it must be precisely coaxially aligned within the repair sleeve disposed concentrically within the tube. Precise coaxial alignment of the laser weld head within the sleeve is necessary because misalignment of the laser weld head will otherwise cause uneven or asymmetrical welding of the sleeve to the tube as the laser weld head rotates within the inside diameter of the sleeve. Such asymmetrical welding may compromise the ability of the weldment to securely affix and seal the sleeve to the inside diameter of the tube. Therefore, another problem in the art is to provide precise coaxial alignment of the laser welding repair probe with the sleeve in order to precisely weld the sleeve to the tube.

A device for checking bent tubes by means of a pneumatically propelled eddy-current probe is disclosed in U.S. Pat. No. 4,633,177 titled "Device For Checking Bent Tubes By a Probe, Such As A Pneumatically Propelled Eddy-Current Probe" issued Dec. 30, 1986 in the name of Bernard David, et al. This patent discloses a probe including a cable having floaters for guiding the cable in the tube, the cable being wound about a coiler. However, this patent does not appear to disclose a solution to the problem of preventing or mitigating twisting or "kinking" of the cable as it unwinds from the coiler. Moreover, this patent does not appear to disclose a solution to the problem of precise coaxial alignment of a repair probe within a sleeve concentrically disposed in a tube.

An apparatus and process for positioning and oscillating heater probes within heat exchanger tubes of a nuclear steam generator is disclosed in U.S. Pat. No. 5,061,176 titled "Apparatus And Process For Simultaneously Positioning And Oscillating A Plurality Of Probes In The Heat Exchanger Tubes Of A Nuclear Steam Generator" issued Oct. 29, 1991 in the name of Paolo R. Zafred, et al. and assigned to the assignee of the present invention. This patent discloses a plurality of probe drivers, wherein each driver includes a pneumatically operated, bladder-type gripper for selectively gripping and ungripping the push-cable of one of the heater probes. However, this patent does not appear to disclose a solution to the problem of preventing twisting or "kinking" of a flexible conduit as it unwinds from a take-up reel. Moreover, this patent does not appear to disclose a solution to the problem of precise coaxial alignment of a repair probe within a sleeve concentrically disposed in a tube.

Therefore, what is needed are an apparatus and method for suitably positioning an examination or repair probe in a tubular member, which tubular member may be a nuclear steam generator heat transfer tube having a corroded portion to be examined and repaired.

SUMMARY

Disclosed herein are an apparatus and method for remotely positioning an examination or repair probe in a tubular member. The tubular member may be a nuclear steam generator heat transfer tube to be examined or repaired by the probe. The probe is connected to a conduit which supports the probe as the probe advances along the inner diameter of the tube to the location of the tube requiring examination or repair. The conduit has a portion thereof wound about a take-up reel. As the probe and conduit advance in the tube, the conduit unwinds from about the take-up reel. However, as the conduit unwinds from about the take-up reel, it may tend to develop a "kinked", twisted or contorted region therein inducing torsional stress in the conduit. Such torsional stress may be severe enough to break the conduit. To solve this problem the apparatus of the present invention includes a gripper capable of gripping the conduit and also includes a rotator connected to the gripper for rotating both the gripper and the conduit as the gripper grips the conduit. As the rotator rotates the gripper, the gripper and a portion of the conduit simultaneously rotate for removing the contorted region so that the torsional stress induced in the conduit is relieved. The apparatus also includes an alignment mechanism for precisely aligning the probe coaxially with the tube.

The invention in its broad form is an apparatus for remotely positioning a probe in a tubular member, the probe having a conduit attached thereto, the conduit having a contorted region therein inducing torsional stress in the conduit, comprising gripper means for gripping the conduit; and rotation means connected to said gripper means for rotating said gripper means and the conduit gripped thereby, so that the conduit is rotated as said gripper means rotates and so that the torsional stress is relieved as the conduit is rotated.

The invention in its broad form is also a method for remotely positioning a probe in a tubular member, the probe having a conduit attached thereto, the conduit defining a contorted region therein inducing torsional stress in the conduit, comprising the steps of gripping the conduit with a gripper; and relieving the torsional stress in the conduit by rotating the gripper with a rotator connected to the gripper, so that the conduit rotates.

An object of the present invention is to provide an apparatus and method for preventing breaking of a flexible conduit connected to a probe as the probe travels in the tubular member and as the conduit unwinds from about a take-up reel.

Another object of the present invention is to allow for precise coaxial alignment of the probe with the tube.

A feature of the present invention is the provision of a gripper for gripping the conduit and the provision of a rotator connected to the gripper for rotating the gripper and thus the conduit gripped thereby in order to relieve torsional stress in the conduit as the conduit unwinds from about the take-up reel.

Yet another feature of the present invention is the provision of an alignment mechanism for precisely coaxially aligning the probe with the tube.

An advantage of the present invention is that severing or breaking of the conduit is prevented as it unwinds from the take-up reel, thereby avoiding the need for costly replacement of the conduit.

Another advantage of the present invention is that a laser welding repair probe is precisely coaxially aligned with a repair sleeve disposed concentrically within the inside diameter of the tube in order to symmetrically weld the sleeve to the tube so that the sleeve is suitably affixed and sealed to the inside diameter of the tube.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings wherein:

DESCRIPTION OF THE PREFERRED EMBODIMENT

Disclosed herein are an apparatus and method for positioning an examination or repair probe in a tubular member, which tubular member may be a nuclear steam generator heat transfer tube having a corroded portion to be examined and repaired.

Figure 1:
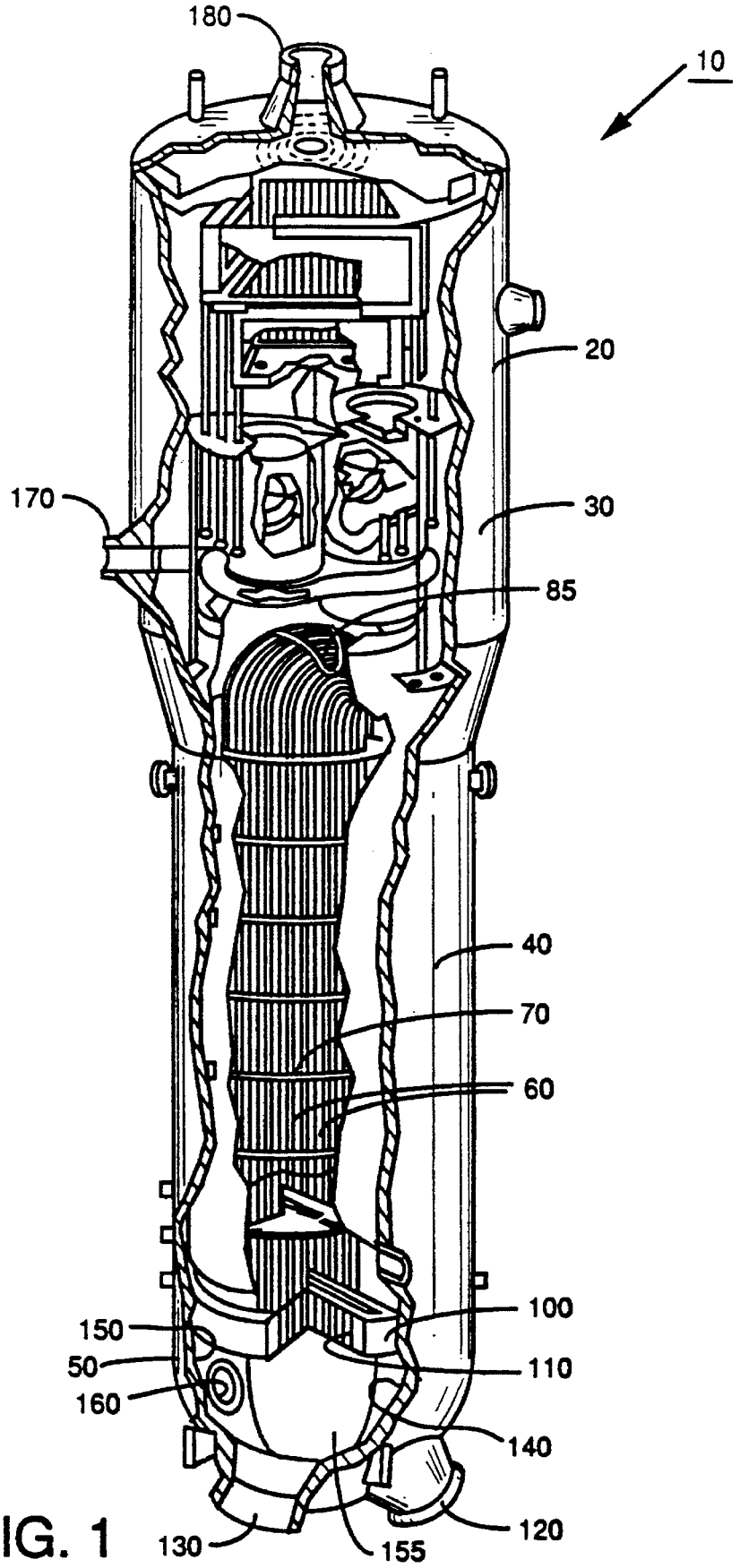
FIG. 1 is a perspective view in partial vertical section of a typical nuclear steam generator with parts removed for clarity, the steam generator having a plurality of U-shaped heat transfer tubes disposed therein.

Referring to FIG. 1, there is shown a typical nuclear steam generator or heat exchanger, generally referred to as 10, for generating steam. Steam generator 10 comprises a shell 20 having an upper portion 30 and a lower portion 40 terminating in a generally bowl-shaped (i.e., hemispherical) portion 50. Disposed in lower portion 40 are a plurality of U-shaped heat transfer tubes 60 that extend through a plurality of support plates 70 which support tubes 60. Each U-shaped tube 60 has an inner diameter 80 (see FIG. 3) and a pair of tube ends 90. As shown in FIG. 1, disposed in lower portion 40 is a tubesheet 100 having a plurality of holes 110 therethrough for receiving tube ends 90. Attached to shell 20 are a first inlet nozzle 120 and a first outlet nozzle 130 in fluid communication with an inlet plenum chamber 140 and with an outlet plenum chamber 150, respectively. Inlet plenum chamber 140 and outlet plenum chamber 150 are located beneath tubesheet 100 and are isolated by a divider plate 155. A plurality of manway openings 160 (only one of which is shown) are formed through shell 20 below tubesheet 100 for allowing access to inlet plenum chamber 140 and outlet plenum chamber 150. Moreover, attached to shell 20 above tubesheet 100 is a second inlet nozzle 170 for entry of a nonradioactive secondary fluid into shell 20. A second outlet nozzle 180 is attached to the top of upper portion 30 for exit of steam from steam generator 10.

However, tubes 60 may not remain leak-tight due to tube wall cracking caused, for example, by the corrosive environment found internally of steam generator 10. If examination of one of the tubes 60 evinces corrosion or degradation, the degraded tube 60 may remain in service by sleeving the degraded portion (not shown) of the tube 60 with a tubular sleeve 190 (see FIG. 3).

Figure 2:
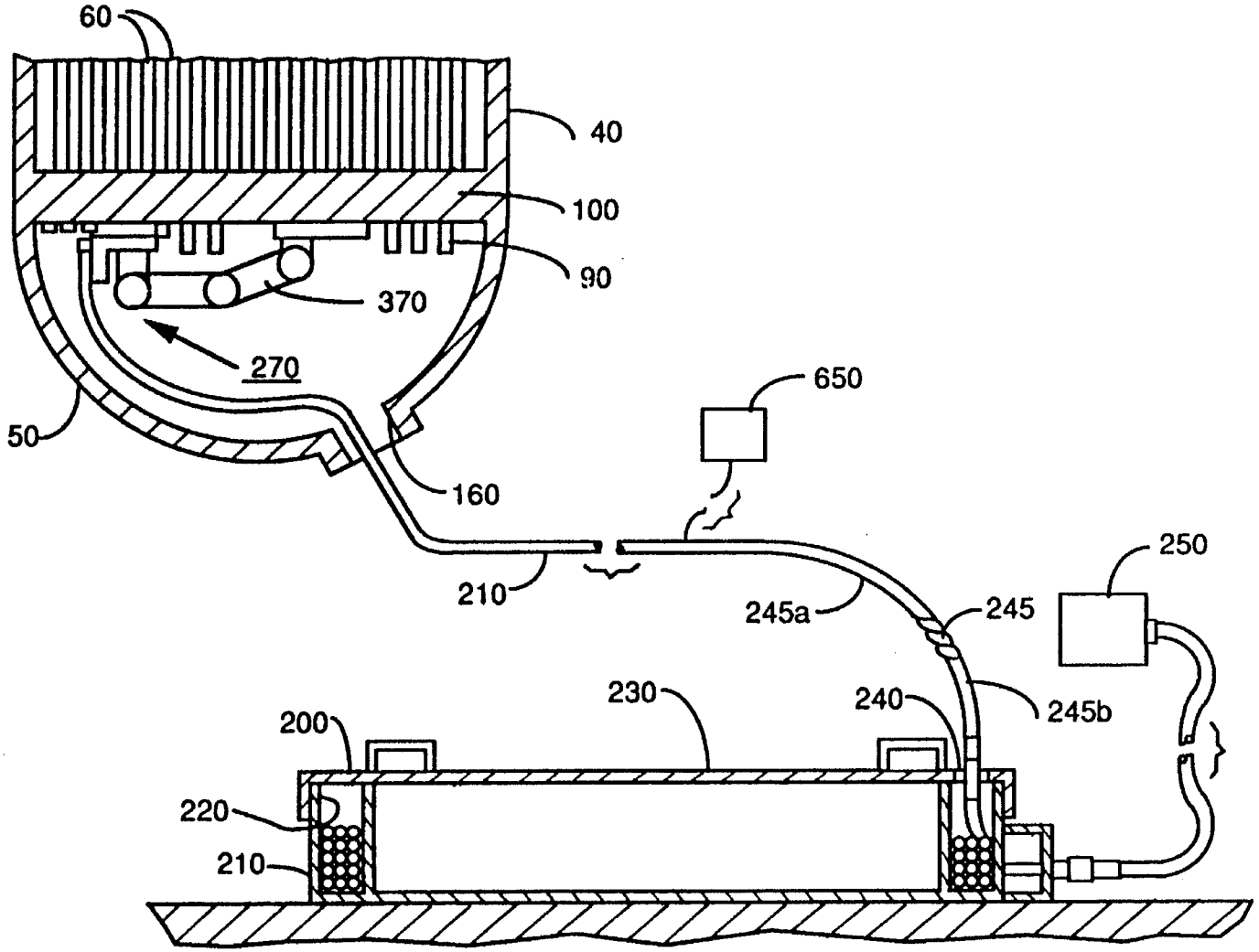
FIG. 2 shows the apparatus of the invention disposed in the steam generator for inspecting or repairing a degraded one of the heat transfer tubes, the apparatus of the invention being connected to a flexible conduit which is in turn wound about a take-up reel, the conduit defining a "kinked", twisted or contorted region therein inducing torsional stress in the conduit as the conduit unwinds from about the take-up reel.

Referring to FIG. 2, a generally circular storage drum or take-up reel 200 is typically provided for compactly storing a flexible conduit 210 in an annular compartment 220 defined by take-up reel 200. Take-up reel 200 may have a cover or lid 230 having a hole 240 therethrough for passage of conduit 210. As conduit 210 is fed from take-up reel 200 and through hole 240, it may tend to develop a "kinked", twisted or contorted region 245 that induces torsional stress in conduit 210. Such induced torsional stress, if not prevented, may be severe enough to sever or break conduit 210, a highly undesirable result. The contorted region 245 is defined by a first portion 245*a* of conduit 210 turned or rotated in a first radial direction and a second portion 245*b* turned or rotated in a second radial direction opposite the first radial direction, the first portion 245*a* and the second portion 245*b* of conduit 210 defining the twisted, "kinked" or contorted region 245 therebetween. An end of conduit may be connected to a control device 250. Control device 250 may be of a type suitable for supplying electrical current to electrical leads (not shown) that extend through conduit 210 and to a non-destructive examination probe, such as an examination probe 260, that is capable of examining tube 60 (see FIG. 3) for degradation. Alternatively, control device 250 may be of a type suitable for supplying hydraulic fluid through conduit 210 to a hydraulically-operated expansion mandrel repair probe 260 that is capable of expanding sleeve 190 into intimate engagement with the inner diameter 80 of tube 60. Furthermore, control device 250 may be of a type suitable for supplying a laser light beam through conduit 210, which may be a fiber optic cable, and to a laser weld head repair probe 260 that is capable of laser welding sleeve 190 to the inner diameter 80 of tube 60. In the instance when conduit 210 is a fiber optic cable, conduit 210 may be surrounded along a portion of its length by a substantially rigid hose (not shown) for guiding conduit 210 and for providing shielding against laser radiation should conduit 210 break. Regardless of whether probe 260 is an examination probe (e.g., an eddy current or ultrasonic probe) or a repair probe (e.g., a hydraulic expansion probe or a laser welding probe), it is desirable to prevent "kinking", twisting or contortion of conduit 210 in order to prevent breaking of conduit 210 as it unwinds from take-up reel 200.

Therefore, referring now to FIGS. 2, 3, 4 and 5 there is shown an apparatus, generally referred to as 270, for remotely positioning probe 260 in tube 60 such that any torsional stress induced in conduit 210 is relieved as it unwinds from take-up reel 200. Relieving torsional stress in conduit 210 prevents severing or breaking of conduit 210. Apparatus 270 comprises a frame or base plate 280 having an attachment device, such as camlock 290, associated therewith and adapted to intimately engage a tube 60' disposed near the tube 60 to be examined and/or repaired. Camlock 290 is capable of being actuated by a pneumatic cylinder 300, which is connected to base plate 280, and is used to removably attach base plate 280 to tube 60' and thus to tubesheet 100. Base plate 280 has a hole 305 therethrough for reasons disclosed in more detail hereinbelow. Attached to base plate 280 are at least one set-off pin 310 and at least one potentiometer 320 for locating base plate 280 a predetermined distance below tubesheet 100, so that base plate 280 does not impact and possibly damage tube ends 90 during the examination and/or repair procedure. A viewing camera 330 may be attached to the underside of base plate 280 for remotely viewing (through hole 305) the process of aligning and inserting probe 260 into tube 60, as described more fully presently. In the preferred embodiment of the invention, camera 330 is attached to the underside of base plate 280 and aligned with hole 305 for viewing the open end of tube 60 through hole 305. Attached to base plate 280 may be at least one lamp 337 for illuminating the space viewable by camera 330. Base plate 280 also has an opening 332 therethrough and a generally V-shaped notch 335 in communication with opening 332 for reasons disclosed hereinbelow.

Figure 3:
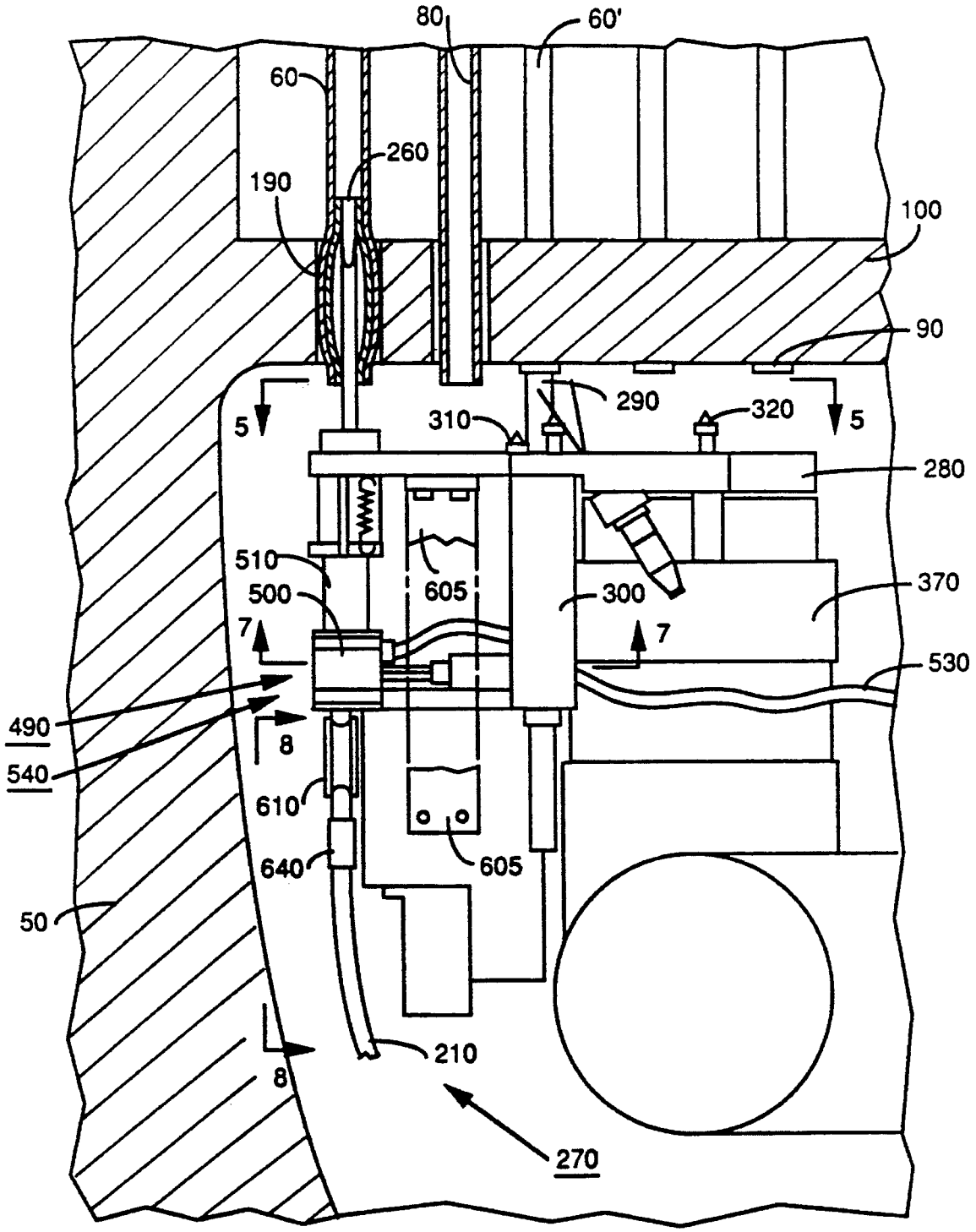
FIG. 3 illustrates in full elevation the apparatus of the invention.
Figure 4:
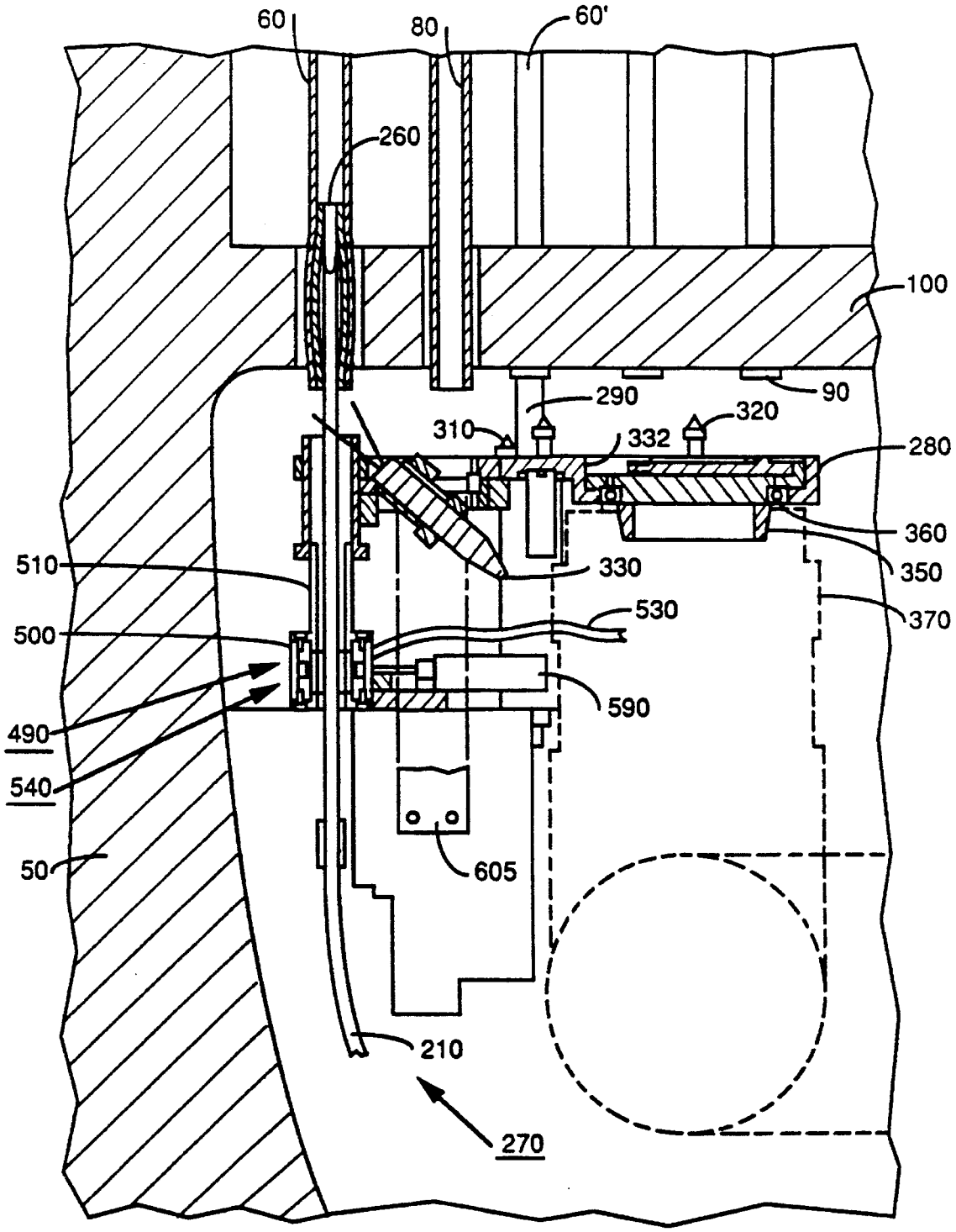
FIG. 4 illustrates in partial elevation the apparatus of the invention.
Figure 5:
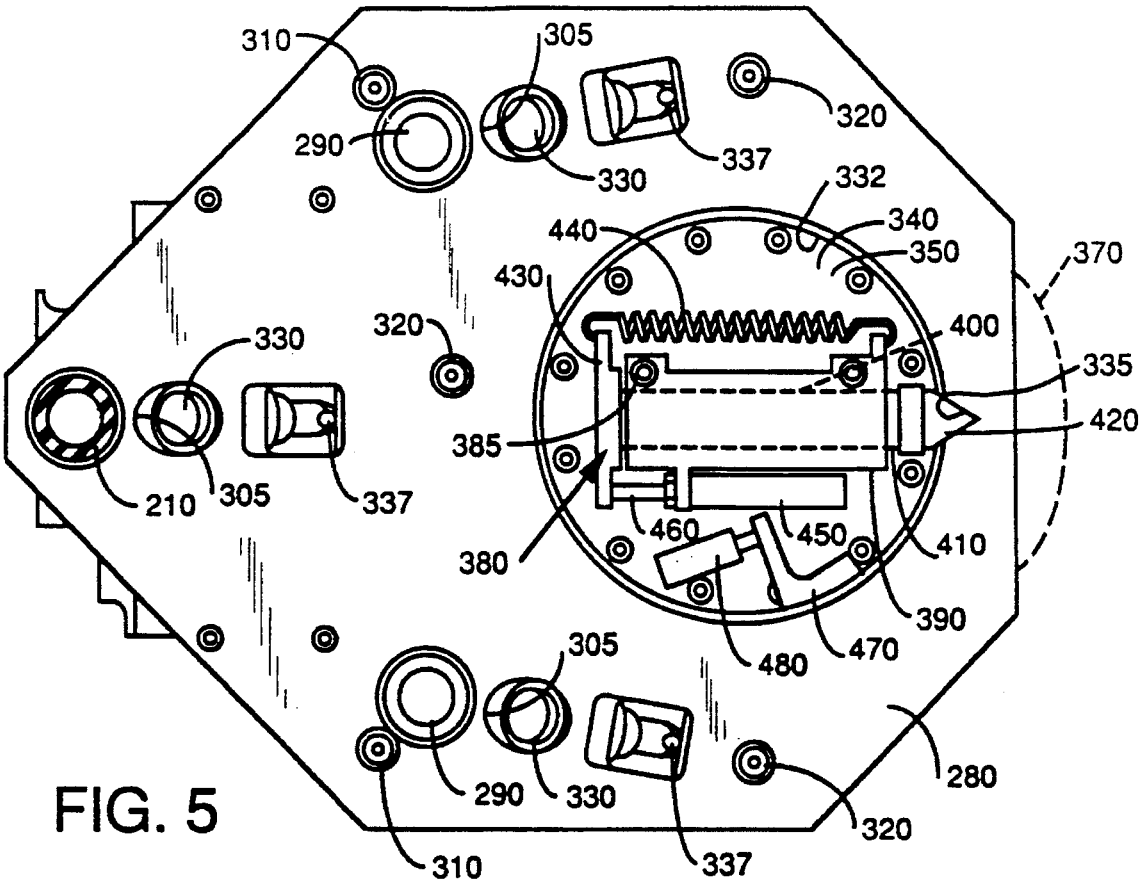
FIG. 5 is a view taken along section line 5—5 of FIG. 3 showing an alignment mechanism for precisely coaxially aligning the probe with the tube.

Turning now to FIGS. 3, 4 and 5, apparatus 270 also comprises alignment means, such as an alignment mechanism 340, for aligning probe 260 coaxially with tube 60. Alignment mechanism 340 comprises a connector ring 350 matingly disposed in opening 332 and rotatably engaging base plate 280. For this purpose, ring 350 slidably rotatably engages a plurality of ball bearings 360 interposed between base plate 280 and ring 350. Removably connected to connector ring 350 is a remotely operated robot 370 for reasons disclosed presently. Operation of robot 370 allows apparatus 270 to be moved to a location near tubes 60 and 60' and enables the operator of robot 370 to obtain gross alignment of camlock 290 with tube 60' and gross alignment of probe 260 with tube 60. In this regard, robot 370 may be a "ROSA" (Remotely Operated Service Arm) robot available from the Westinghouse Electric Corporation located in Pittsburgh, Pa. Such a "ROSA robot is disclosed in U.S. patent application Ser. No. 07/607,705 titled "Improved Robotic System For Servicing The Heat Exchanger Tubes Of A Nuclear Steam Generator" filed Nov. 1, 1990, in the name of Paul J. Boone et al., the disclosure of which is hereby incorporated by reference. The operator views the alignment process by means of cameras 330 and takes any necessary corrective action to compensate for misalignment. Baseplate 280 is vertically moved (by means of robot 370) until potentiometers 320 engage tubesheet 100. Potentiometers 320 provide feedback such that the operator of robot 370 can adjust baseplate 280 parallel to tubesheet 100 and sufficiently below tubesheet 100 so that tube ends 90 are not damaged.

As best seen in FIG. 5, alignment mechanism 340 further comprises a spring-loaded alignment register, generally referred to as 380, attached to rotatable ring 350, such as by screw-bolts 385, for precisely aligning probe 260 with tube 60, as disclosed in more detail presently. Alignment register 380 includes an enclosure 390 having a longitudinal bore 400 therethrough. Slidably received in bore 400 is an elongate shaft 410 having a first end and a second end. For reasons disclosed in detail hereinbelow, integrally attached to the first end of shaft 410 is a generally wedge-shaped nose member 420 capable of matingly engaging or registering with notch 335. Moreover, integrally attached to the second end of shaft 410 is a foot member 430. Interconnecting foot member 430 and enclosure 390 is a compression spring member 440 for biasing shaft 410 such that nose member 420 engages and locks into notch 335. Moreover, attached to enclosure 390 is a pneumatic cylinder 450 having a pneumatically-activated reciprocatable plunger 460 adapted to engage foot member 430 such that foot member 430, and hence shaft 410, move as cylinder 450 outwardly extends plunger 460. It will be understood from the description hereinabove that as plunger 460 outwardly extends from cylinder 450, it will engage foot member 430. As foot member 430 is engaged by plunger 460, it will bias or move shaft 410 such that nose member 335 can not register with or engage notch 335. Of course, as cylinder 450 is deactivated, plunger 460 inwardly returns into cylinder 450. When plunger 460 inwardly returns into cylinder 450, the compressive force that spring member 440 exerts on foot member 430 will bias or move foot member 430 in order to slide shaft 410 in bore 400. As shaft 410 slides in bore 400, nose member 420 will register or engage notch 335 in order to lock the position of rotatable connector ring 350 with respect to robot 370.

Still referring to FIG. 5 alignment mechanism 340 may further comprise a bracket 470 attached to base plate 280 and a potentiometer 480 attached to connector ring 350. Potentiometer 480 engages bracket 470 as connector ring 350 rotates in opening 332 in order to precisely obtain the rotational alignment of connector ring 350 with respect to base plate 280. In this regard, it will be appreciated that the rotational orientation of baseplate 280 may not initially allow the proper alignment of camlocks 290 with tubes 60'. When this occurs, camlocks 290 will not slidably engage tubes 60' and probe 260 will not be suitably aligned with tube 60. In order to avoid such an occurrence, course alignment of camlocks 290 with tubes 60' and course alignment of probe 260 with tube 60 is obtained by the operator of robot 370, as previously mentioned. However, due to clearance between camlocks 290 and the inside diameter of tubes 60', probe 260 may not necessarily be concentrically disposed with respect to tube 60. As stated previously, it is particularly important that probe 260 be concentrically disposed with respect to tube 60 when probe 260 is a laser welding device. In order to concentrically dispose probe 260 with respect to tube 60, radial expansion of camlocks 290 into engagement with tubes 60' imparts laterally-acting forces on baseplate 280, which forces tend to bring probe 60 into concentric alignment with tube 60.

Referring yet again to FIG. 5, the inherent torsional rigidity of robot 370 resists the rotation of baseplate 280, thereby interfering with obtaining the precise alignment of probe 260 with tube 60. In order to solve this problem, the disengagement of nose member 420 from notch 335 allows rotation of connector ring 350 in opening 332 of baseplate 280, at least until the previously mentioned forces imparted by camlocks 290 on baseplate 280 are substantially equalized. When this occurs, probe 260 is precisely aligned concentric with tube 60. Of course, the rotational movement of connector ring 350 is monitored by the feedback from potentiometer 480. Thus, by use of potentiometer 480, the operator of robot 370 can rotate connector ring 350 to align nose member 420 with notch 335 and hence to align probe 260 with tube 60. When this occurs, nose member 420 is caused to engage notch 335 in the manner previously described to fix the desired alignment of probe 260 with tube 60.

Figure 6:
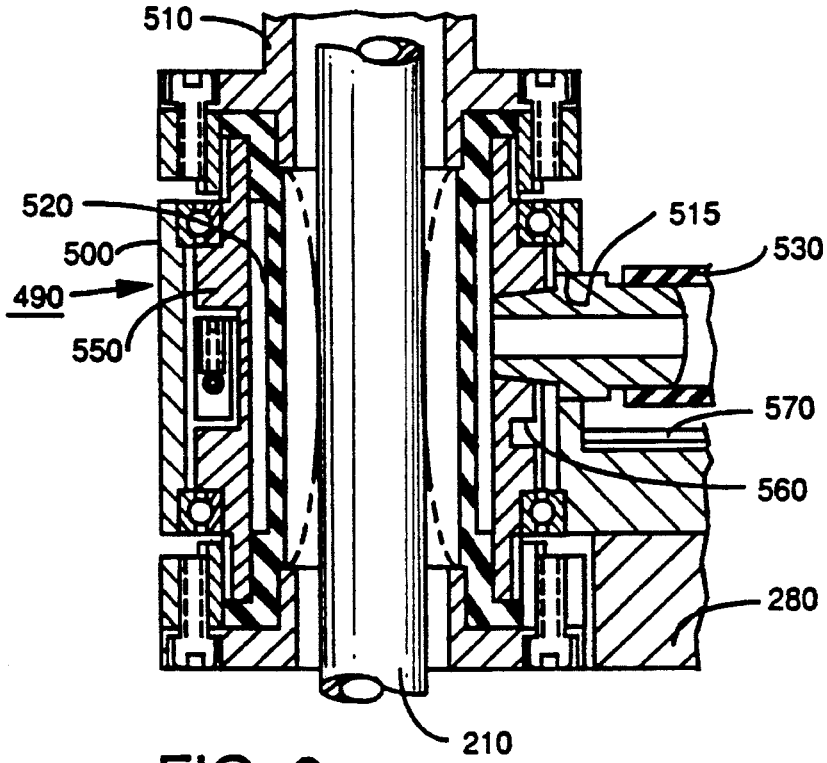
FIG. 6 is a fragmentation view in vertical section of a gripper capable of gripping the conduit for supporting the conduit in the tube.

Referring now to FIGS. 4 and 6, apparatus 270 further comprises gripper means, generally referred to as 490, for gripping conduit 210, so that conduit 210 is supported thereby. Gripper means 490 comprises a generally cylindrical gripper enclosure 500 connected to an elongate generally cylindrical hollow enclosure extension 510, which is in turn attached to base plate 280. Gripper enclosure has an opening 515 therethrough for reasons disclosed presently. Gripper enclosure 500 houses an annular, resilient, and radially collapsible bladder 520 concentrically mounted therein for gripping and ungripping conduit 210. In communication with opening 515 is a hose 530 for supplying a fluid, such as air or water or the like, to bladder to inwardly collapse bladder 520 into engagement with conduit 210, as illustrated by the phantom lines in FIG. 6, so that bladder 520 grips conduit 210.

Figure 7:
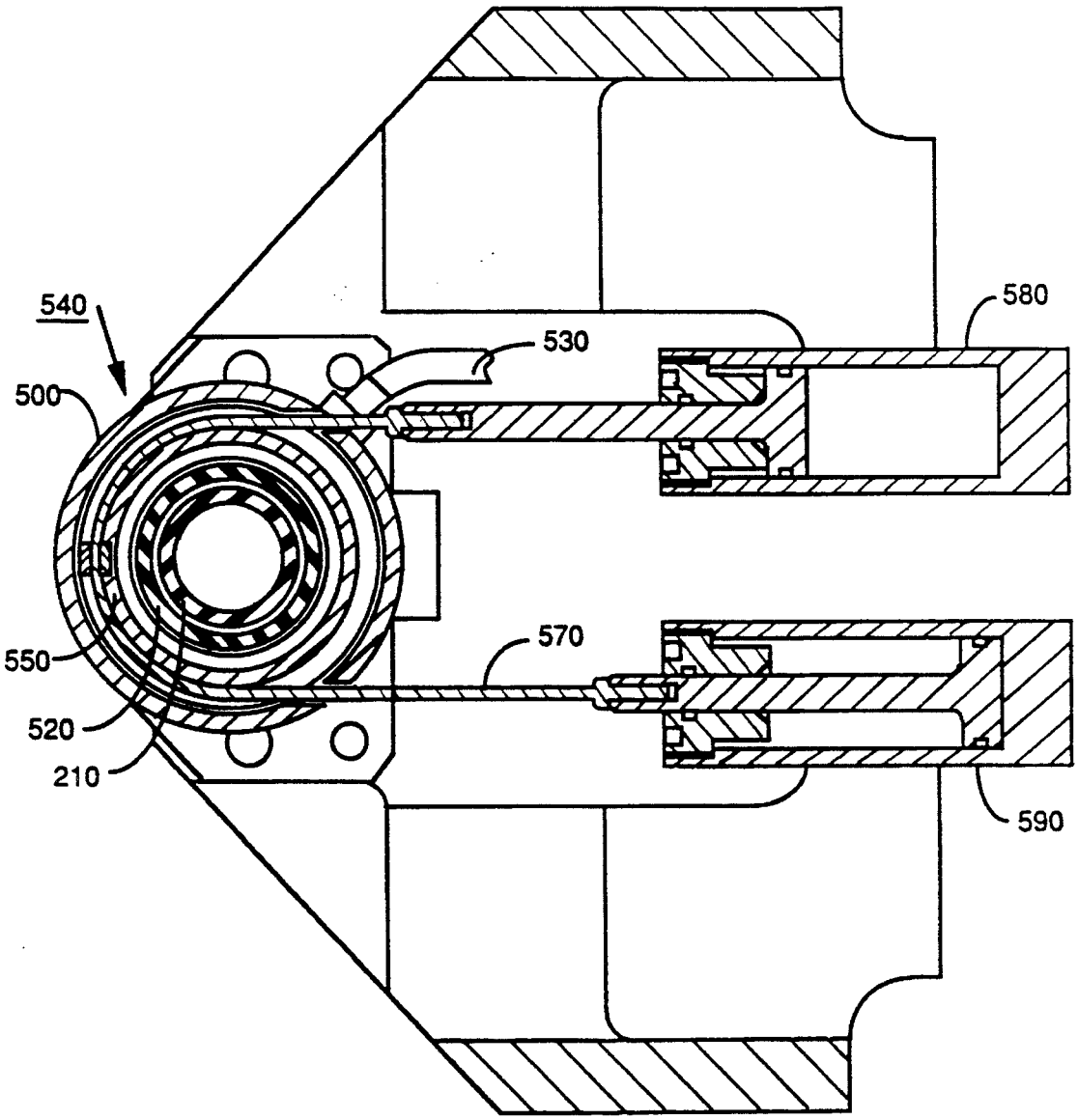
FIG. 7 is a view taken along section line 7—7 of FIG. 3 showing a rotator for rotating the gripper and thus the conduit gripped thereby, so that torsional stress in the conduit is relieved as the conduit is rotated by the rotator.

Referring to FIGS. 4 and 7, apparatus 270 further comprises rotation means, generally referred to as 540, for rotating bladder 520 and thus conduit 210 as bladder 520 grips conduit 210. Rotation means 540 includes a generally cylindrical and hollow inner housing 550 interposed between bladder 520 and enclosure 500. Inner housing 550 is connected to bladder 520 so as to surround bladder 520 and radially slidably engage enclosure 500. Moreover, inner housing 550 has a groove 560 extending therearound for matingly receiving a cord 570 therein. Cord 570 has a first end thereof attached to a movable or reciprocatable first piston 580 connected to base plate 280, first piston 580 being capable of pulling the first end of cord 570. Cord 570 also has a second end thereof attached to a movable or reciprocatable second piston 590 connected to base plate 280, second piston 590 being capable of pulling the second end of cord 570. As first piston 580 pulls the first end of cord 570, inner housing 550, and thus bladder 520 connected to inner housing 550, will rotate in a first direction (e.g., clockwise). As second piston 590 pulls the second end of cord 570, inner housing 550, and thus bladder 520 connected to inner housing 550, will rotate in a second direction (e.g., counter-clockwise). Thus, it will be understood from the description hereinabove, that as bladder 520 rotates, conduit 280 also rotates to a like extent because bladder 520 securely grips conduit 280 when bladder 520 is collapsed about conduit 280. In the preferred embodiment, pistons 580/590 may be pneumatically operated and computer controlled for precisely controlling the movement of pistons 580/590.

Figure 8:
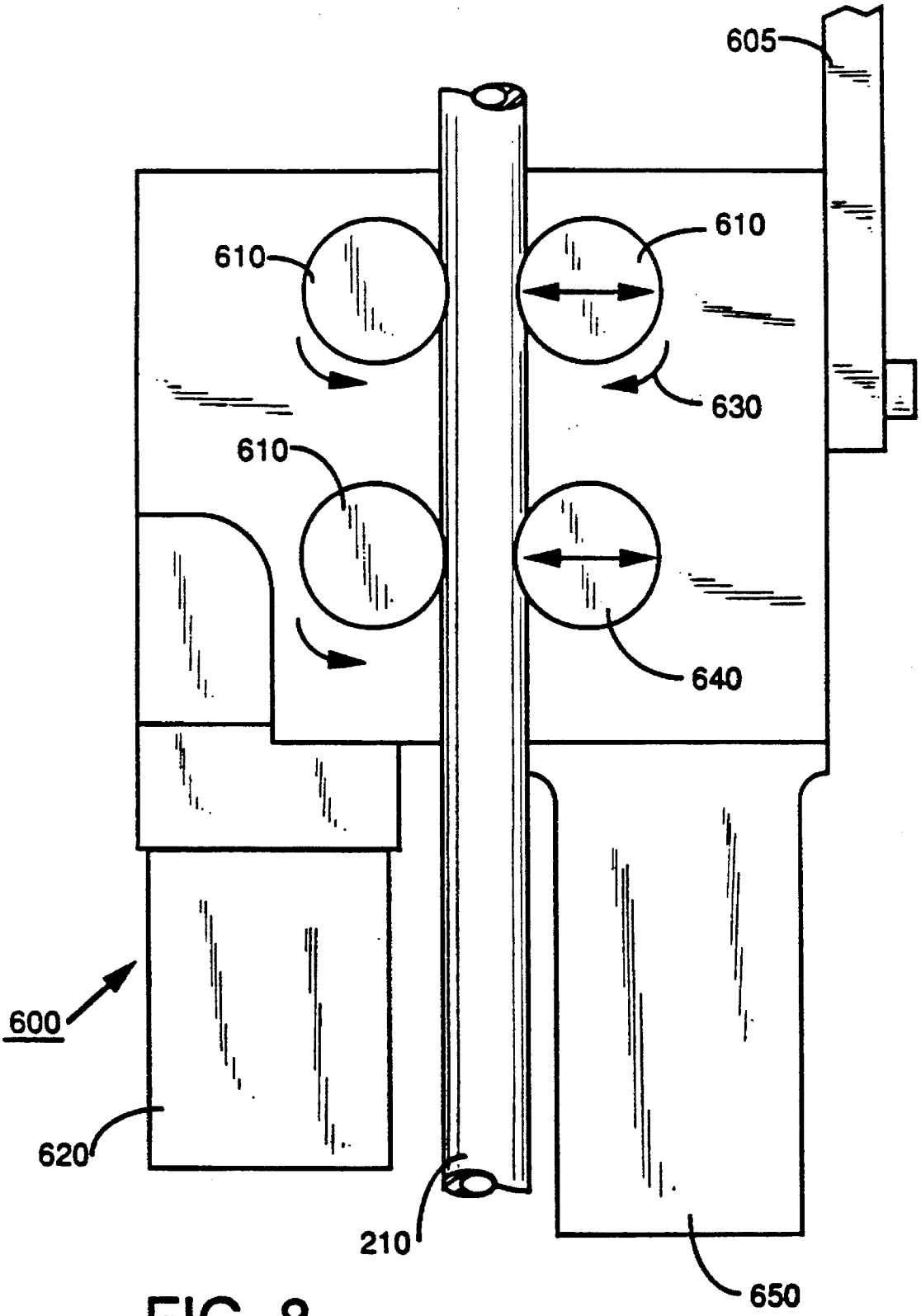
FIG. 8 is a view taken along section line 8—8 of FIG. 3 showing a plurality of traction wheels and an encoder wheel engaging the conduit for translating the probe in the tube and for providing positional feedback associated with the axial position of the probe in the tube, respectively.

As best seen in FIG. 8, apparatus 270 also comprises conduit drive means, such as a conduit driver, generally referred to as 600, for moving conduit 210 into and out-of tube 60. Conduit driver 600 is connected to base plate 280, such as by support plate 605, and includes a plurality of rotatable wheels 610 for engaging conduit 210. Wheels 610 are driven by a motor 620 in the direction of the curved arrows 630 shown in FIG. 8 for moving conduit 210 along the inside diameter 80 of tube 60. Conduit driver 600 may also include an encoder wheel 640 actuated by an encoder wheel actuator 650 to engage and disengage conduit 210. The purpose of encoder wheel 640 is to measure the axial position of probe 260 in tube 60. Apparatus 270 may further include suitable sensory means connected to conduit 210 for automatically sensing the torsional stress induced in conduit 210 by operating sensory means, such as a sensor 650, connected to conduit 210. The sensor generating an output signal in response to the torsional stress sensed by said sensor. In this manner, the torsional stress is relieved by operating the gripper means 490 and the rotation means 540 in response to the output signal.

OPERATION

Robot 370 is inserted through manway 160 and attached to the underside of tubesheet 100 by use of camlocks 290. Connector ring 350 is rotated until nose member 420 is aligned with notch 335. As connector ring 350 rotates, bracket 470 and potentiometer 480 coact to precisely measure the amount rotation of connector ring 350. As nose member 420 comes into alignment with notch 335, pneumatic cylinder 350 is deactivated, such that spring member 440 causes shaft 410 to inwardly slidably travel in bore 400. Nose member 420 will then register in notch 335 to affix the position of connector ring 350 with respect to robot 370. Camlock 290 is inserted into tube 60' and expanded to engage tube 60' to securely suspend base plate 280 beneath tubesheet 100 and to precisely align probe 260 with tube 60.

Conduit driver 600 is then operated to drive conduit 210, and probe 260 connected thereto, into tube 60. In this regard, motor 620 is operated to rotate wheels 610 in order to drive conduit 210 axially in tube 60. Moreover, encoder actuator 650 may be operated so that encoder wheel 640 engages conduit to measure the distance of travel of conduit 210 in tube 60. Cameras 330 and lamps 337 are used to observe the alignment and advancement of probe 260 and conduit 210 into tube 60.

As conduit 210 travels in tube 60, it will unwind from take-up reel 200. However, as conduit 210 unwinds from take-up reel 200, it may tend to develop the twisted, "kinked" or contorted region 245 that induces torsional stress in conduit 210. Such induced torsional stress may be severe enough to sever or break conduit 210, which is highly undesirable. Therefore, it is important to prevent, relieve or mitigate such induced torsional stress.

When contorted region 245 is observed in conduit 210, the rotation of wheels 610 is stopped such that the advancement of conduit 210 in tube 60 ceases. Fluid (e.g., air or water or the like) is supplied to bladder 520 through hose 530 in order to inwardly radially collapse bladder 520 into intimate engagement with conduit 210. As bladder 520 inwardly collapses, it will securely grip conduit 210. Wheels 610/640 are then caused to disengage conduit 210. Next, either one of pistons 580/590 is selectively activated to rotate inner housing 520. As inner housing 520 rotates, bladder 520 simultaneously rotates to a like extent, thereby rotating conduit 210 because bladder 520 securely grips conduit 210. As conduit 210 rotates, twisted or contorted region 245 is removed from conduit 210 in order to relieve or mitigate the torsional stress induced in conduit 210 by region 245. That is, first portion **245*a* of conduit 210 rotates as bladder 520 rotates because bladder 520 securely grips first portion 245*a*. The first portion 245*a* is rotated until it is brought into substantial rotational alignment with second portion 245*b* of conduit 210. When this occurs, contorted region 245 is substantially removed from conduit 210. After twisted or contorted region 245 is removed from conduit 210, the fluid is bled from bladder 520, so that bladder 520 relaxes and disengages (i.e., ungrips) conduit 210. Next, wheels 610 and 640 are reactivated to re-engage and advance conduit 210 and probe 260 connected thereto along the inside diameter 80 of tube 60. After tube 60 is suitably examined and/or repaired (e.g., sleeved), take-up reel 200 is operated to re-wind conduit 210** thereabout for storage.

It will be understood from the teachings herein that an advantage of the present invention is that severing or breaking of conduit 210 is prevented or mitigated as it unwinds from the take-up reel 200. Preventing breaking of conduit 210 avoids the need for costly replacement of conduit 210. It will be further understood from the teachings herein that another advantage of the present invention is that a laser welding probe is precisely coaxially alignable with tube 60, or within any repair sleeve 190 disposed concentrically within the tube 60, in order to symmetrically weld the sleeve 190 to the tube 60 for suitably affixing and sealing the sleeve to tube 60.

Although the invention is illustrated and described herein in its preferred embodiment, it is not intended that the invention as illustrated and described be limited to the details shown, because various modifications may be obtained with respect to the invention without departing from the spirit of the invention or the scope of equivalents thereof. For example, gripper means 490 need not only be used to relieve torsional stress in a conduit 210 that is being advanced within a nuclear steam generator heat transfer tube. Rather, gripper means 490 is usable to relieve torsional stress induced by a twisted or contorted region in any similar conduit.

Therefore, what is provided are an apparatus and method for remotely positioning an examination or repair probe in a tubular member, which tubular member may be a nuclear steam generator heat transfer tube having a corroded portion to be examined and repaired.

What is claimed is:

1. An apparatus for remotely positioning an extended conduit into a remote radioactive environment, the conduit having a contorted region therein inducing torsional stress in the conduit, the conduit having a probe connected thereto, comprising:

(a) means for remotely extending the conduit into the environment;

(b) mechanized means engaging the conduit for relieving the torsional stress induced in the conduit;

(c) sensory means connected to the conduit for automatically identifying the torsional stress induced in the conduit, said sensory means generating an output signal in response to the torsional stress sensed thereby; and (d) means responsive to the output signal for operating said mechanized means to relieve the torsional stress.

2. The apparatus of claim 1, wherein said mechanized means comprises:

(a) gripper means for gripping the conduit; and (b) rotation means connected to said gripper means for rotating said gripper means and the conduit gripped thereby, so that the conduit is rotated as said gripper means rotates and so that the torsional stress is relieved as the conduit is rotated.

3. An apparatus for remotely positioning an extended conduit in a tubular member disposed in a remote radioactive environment, the conduit having a contorted region therein inducing torsional stress in the conduit, the conduit having a probe connected thereto comprising:

(a) gripper means for gripping the conduit;

(b) rotating means connected to said gripper means for rotating said gripper means and the conduit gripped thereby, so that the conduit is rotated as said gripper means rotates and so that the torsional stress is relieved as the conduit is rotated;

(c) sensory means connected to the conduit for automatically identifying the torsional stress induced in the conduit, said sensory means generating an output signal in response to the torsional stress sensed thereby; and (d) means responsive to the output signal for operating said mechanized means to relieve the torsional stress.

4. The apparatus of claim 3, further comprising alignment means connected to the probe for aligning the probe with the tubular member.

5. The apparatus of claim 3, wherein the probe is a laser welding probe for use on corroded areas of the tubular member.

6. The apparatus of claim 3, further comprising conduit drive means engaging the conduit for driving the conduit in the tubular member.

7. An apparatus for remotely positioning an extended conduit in a tubular member disposed in a remote radioactive environment, the conduit having a first portion turned in a first direction and a second portion turned in a second direction opposite the first direction, the first portion and the second portion defining a contorted region therebetween inducing torsional stress in the conduit, the conduit having a probe connected thereto, the apparatus comprising:

(a) gripper means for gripping the first portion of the conduit;

(b) rotating means connected to said gripper means for rotating said gripper means and the conduit gripped thereby to rotate the first portion of the conduit in the second direction, so that the torsional stress is relieved as the first portion of the conduit is rotated;

(c) sensory means connected to the conduit for automatically identifying the torsional stress induced in the conduit, said sensory means generating an output signal in response to the torsional stress sensed thereby; and (d) means responsive to the output signal for operating said gripper means and said rotating means to relieve the torsional stress.

8. The apparatus of claim 7, where said gripper is a collapsible bladder.

9. The apparatus of claim 7, wherein said rotation means is a pulley assembly surrounding said gripper means.

10. The apparatus of claim 7, further comprising alignment means connected to the probe for aligning the probe with the tubular member.

11. The apparatus of claim 7, further comprising conduit drive means engaging the conduit for driving the conduit and the probe connected thereto in the tubular member.

12. An apparatus for remotely positioning an extended conduit in a tube disposed in a remote radioactive environment, the conduit having a first portion turned in a first direction and a second portion turned in a second direction opposite the first direction, the first portion and the second portion defining a contorted region therebetween inducing torsional stress in the conduit, the conduit having a probe connected thereto, the apparatus comprising:

(a) a baseplate;

(b) a gripper connected to said baseplate for gripping the first portion of the conduit;

(c) a rotator connected to said baseplate and said gripper for rotating said gripper and the conduit gripped thereby to rotate the first portion of the conduit in the second direction, so that the torsion stress is relieved as the first portion of the conduit is rotated in the second direction;

(d) sensory means connected to the conduit for automatically identifying the torsional stress induced in the conduit, said sensory means generating an output signal in response to the torsional stress sensed thereby; and (e) means responsive to the output signal for operating said gripper and said rotator to relieve the torsional stress.

13. The apparatus of claim 12, wherein said gripper is a collapsible bladder.

14. The apparatus of claim 12, wherein said rotator is a piston-activated pulley assembly surrounding said gripper.

15. The apparatus of claim 12, further comprising an alignment mechanism connected to the probe for aligning the probe with the tube.

16. The apparatus of claim 12, further comprising a conduit driver engaging the conduit for driving the conduit and the probe connected thereto in the tube.

17. For use in a nuclear heat exchanger having a plurality of heat transfer tubes disposed therein, an apparatus for remotely positioning an extended flexible conduit in a predetermined one of the tubes, the conduit having a first portion turned in a first direction and a second portion turned in a second direction opposite the first direction, the first portion and the second portion defining a contorted region therebetween inducing torsional stress in the conduit, the conduit having a probe connected thereto, the apparatus comprising:

(a) a baseplate disposed adjacent the tube;

(b) a rotatable gripper connected to said baseplate for rotatably gripping the first portion of the conduit, said gripper including a resilient collapsible bladder capable of gripping the first portion of the conduit;

(c) a rotator connected to said baseplate and to said gripper for rotating said gripper and the conduit gripped thereby to rotate the first portion of the conduit in the second direction, so that the torsional stress is relieved as the first portion of the conduit is rotated in the second direction, said rotator including:

(i) a piston-driven pulley surrounding said gripper;

(ii) a cord engaging said pulley for rotating said pulley, so that said bladder and the first portion of the conduit gripped thereby rotate as said pulley rotates, said cord having an end; and (iii) a movable piston connected to the end of said cord for pulling the end of said cord, so that said pulley rotates said bladder and the first portion of the conduit in the second direction as the end of the cord is pulley by said piston;

(d) an alignment mechanism connected to the probe for aligning the probe concentrically with the tube; and (e) a conduit driver engaging the conduit for driving the conduit and the probe connected thereto in the tube.

18. The apparatus of claim 17, further comprising a remotely operated robot connected to said baseplate for positioning said baseplate adjacent the tube.

19. The apparatus of claim 17, further comprising:

(a) sensory means connected to the conduit for automatically identifying the torsional stress induced in the conduit, said sensory means generating an output signal in response to the torsional stress sensed thereby; and (b) means responsive to the output signal for operating said gripper and said rotator to relieve the torsional stress.

20. A method for remotely positioning an extended conduit in a tubular member disposed in a radioactive environment, the conduit defining a contorted region therein inducing torsional stress in the conduit, the conduit having a probe connected thereto, comprising the steps of:

(a) gripping the conduit with a gripper;

(b) relieving the torsional stress in the conduit by rotating the conduit with a rotator connected to the gripper;

(c) automatically sensing the torsional stress induced in the conduit by operating a sensor connected to the conduit, the sensor generating an output signal in response to the torsional stress sensed by said sensor; and (d) relieving the torsional stress by operating the gripper and the rotator in response to the output signal.

21. The method of claim 20, further comprising the step of aligning the probe with the tubular member by operating an alignment mechanism connected to the probe.

22. The method of claim 20, further comprising the step of driving the conduit in the tube by operating a conduit driver engaging the conduit.

23. The method of claim 20, further comprising the step of supplying the conduit from a reel on which it is wound to a compact form, the conduit having a laser welding probe connected thereto for use on corroded areas of the tubular member.

24. In a nuclear heat exchanger having a plurality of heat transfer tubes disposed therein, a method for remotely positioning an extended flexible conduit in a predetermined one of the tubes, the conduit having a first portion turned in a first direction and a second portion turned in a second direction opposite the first direction, the first portion and the second portion defining a contorted region therebetween inducing torsional stress in the conduit, the conduit having a probe connected thereto, the method comprising the steps of:

(a) disposing a baseplate adjacent the tube;

(b) gripping the first portion of the conduit with a rotatable gripper connected to the baseplate, the gripper including a resilient collapsible bladder capable of engaging the first portion of the conduit;

(c) relieving the torsional stress in the conduit by rotating the first portion of the conduit in the second direction to remove the contorted region;

(d) aligning the probe concentrically with the tube by operating an alignment mechanism connected to the probe; and (e) driving the conduit and the probe connected thereto in the tube by operating a conduit driver engaging the conduit.

25. The method of claim 24, further comprising the step of positioning the frame adjacent the tube by remotely operating a robot connected to the baseplate.

26. The method of claim 24, further comprising the steps of:

(a) automatically sensing the torsional stress induced in the conduit by operating a sensor connected to the conduit, the sensor generating an output signal in response to the torsional stress sensed by said sensor; and (b) relieving the torsional stress by operating the gripper and the rotator in response to the output signal.

* * * * *